US007963290B2

(12) United States Patent
Havlin

(10) Patent No.: US 7,963,290 B2
(45) Date of Patent: Jun. 21, 2011

(54) HAIR STYLING TOOL, SYSTEM AND METHOD OF USE

(76) Inventor: Elizabeth Jean Havlin, Seattle, WA (US)

( * ) Notice: Subject to any disclaimer, the term of this patent is extended or adjusted under 35 U.S.C. 154(b) by 932 days.

(21) Appl. No.: 11/625,304

(22) Filed: Jan. 20, 2007

(65) Prior Publication Data

US 2010/0186765 A1 Jul. 29, 2010

(51) Int. Cl.
*A45D 7/00* (2006.01)
*A45D 8/00* (2006.01)

(52) U.S. Cl. ..... 132/210; 132/273

(58) Field of Classification Search ..... 132/200, 132/275, 273, 274, 280, 282, 210; D28/32, D28/33, 39, 41
See application file for complete search history.

(56) References Cited

U.S. PATENT DOCUMENTS

| | | | | |
|---|---|---|---|---|
| 272,698 | A * | 2/1883 | Humphries | 132/273 |
| 5,833,335 | A * | 11/1998 | Voughlohn | 132/273 |
| 6,267,120 | B1 * | 7/2001 | Serignat | 132/273 |
| 2005/0199255 | A1 * | 9/2005 | Silva | 132/144 |

* cited by examiner

*Primary Examiner* — Rachel R Steitz
(74) *Attorney, Agent, or Firm* — Christensen O'Connor Johnson Kindness PLLC

(57) ABSTRACT

A winding and fastening device which utilizes a flexible body part (1-A), an elastic band and a pointed contoured stick, or pick, or rod (1-C) to arrange and secure flexible material, such as human or animal hair in a desired position.

10 Claims, 10 Drawing Sheets

HAIR STYLING TOOL, SYSTEM AND METHOD OF USE

TECHNICAL FIELD

This invention relates to personal use, namely, hair styling and grooming of humans and animals.

BACKGROUND

Due to the increased desire to have attractive yet functional hairstyles while performing job duties and day-to-day activities, this invention enables the user to arrange secure human hair and other flexible materials, such as false hair or hair extensions, in a way which is functional, pleasing to the eye, and easy to use.

SUMMARY

In accordance with one aspect of the invention, a flexible body part is provided which can be flexed horizontally, vertically, or a combination of both. The flexible body part contains openings which accommodate the insertion and retention of an elastic band or elastic material. A flexible material, such as hair, is inserted between the body part and the elastic material. When the body part is twisted, or rolled, the flexible material is contained and retained between the body part and the elastic material.

In accordance with the next aspect of the invention, a stick, or pick, or rod is provided, with said stick, pick, or rod ideally having one pointed end and one contoured end and being of an overall cylindrical shape. The stick, or pick, or rod is inserted into an opening at one end of the flexible body part, then underneath, through, over, or around the flexible material, then out through an opening in the opposite end of the body part, thus securing the flexible material, such as hair, in the desired position.

In accordance with the last aspect of the invention, a method of use for winding, fastening, styling, and securing a flexible material is provided. The method of use contains but is not limited to inserting the flexible material, such as hair, between a flexible body part and an elastic material, then winding, fastening, positioning, or styling said material into a desired arrangement. The method is continued by inserting a pointed stick, or pick, or rod into an opening in one end of the flexible body part, then sliding the stick, pick, or rod through, over, underneath, or around the flexible material, then securing the flexible material by sliding the pointed end of the stick, pick, or rod out through an opening in the opposite end of the body part, thus securing the flexible material in a desired arrangement.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
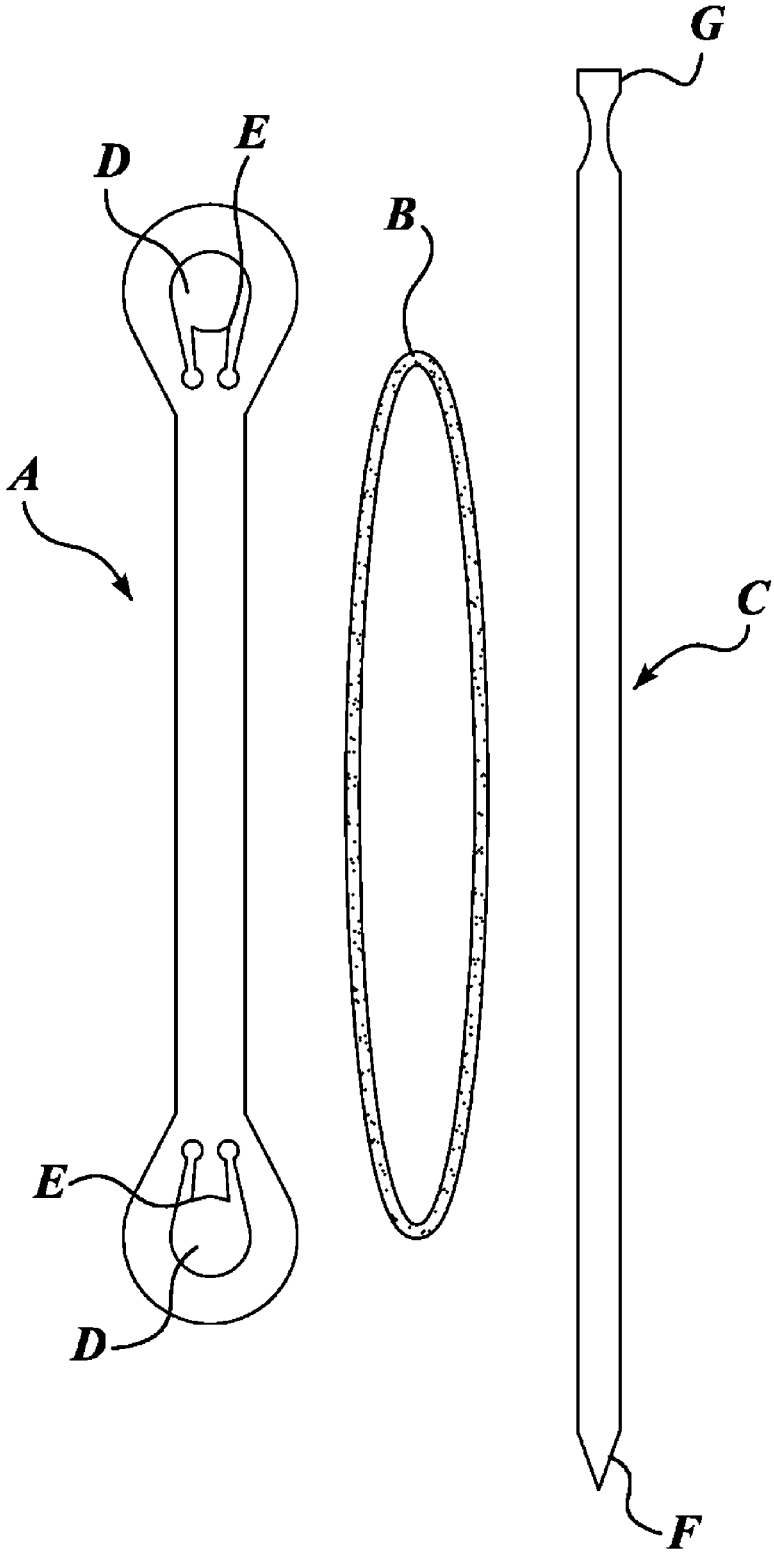
FIGS. 1 and 2 are front views of the invention, disassembled and partially assembled, respectively.
Figure 2:
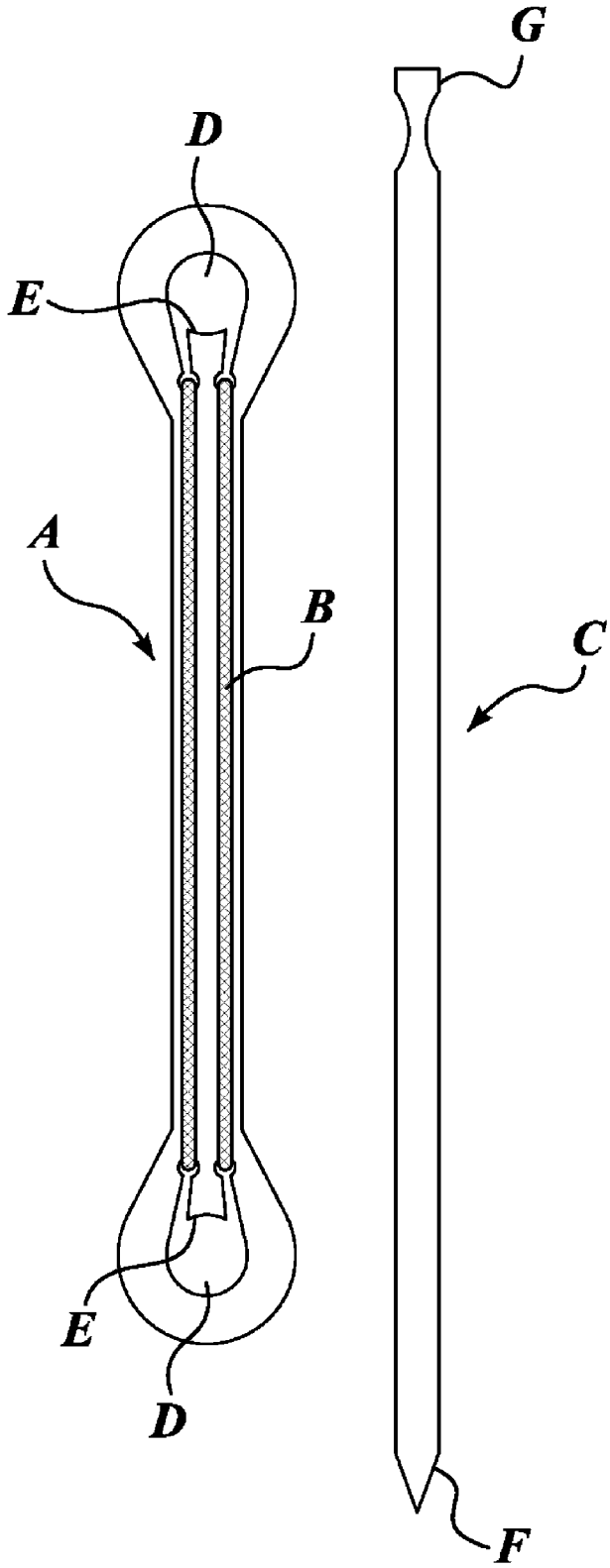

With reference to FIGS. 1 and 2, the characters A, B, C, D, E, F, and G illustrate the vital working elements of the invention, without which the invention could not be assembled or function correctly. "A"—as shown, represents the whole of the flexible body part. "B"—as shown, represents the elastic band or elastic material. "C"—as shown, represents the whole of the pointed contoured stick. "D"—as shown, represents the openings in the ends of the body part, which must be of such a shape as to accommodate the insertion and retention of both "B" and "C" together or separately. "E"—as shown, represents a protrusion extending from the flexible body part (A) partially into the openings "D." The ideal shape of the openings "D" in the ends of the flexible body part (A) and the protrusions "E" allow the elastic band (B) to lie flat against the flexible body part (A) when the elastic band (B) is inserted and fastened around the protrusions "E" in the openings (D). "F"—as shown, illustrates the pointed end of the stick, or pick, or rod (C). "G"—as shown, illustrates the opposite contoured end of the stick, pick, or rod (C).

Figure 3:
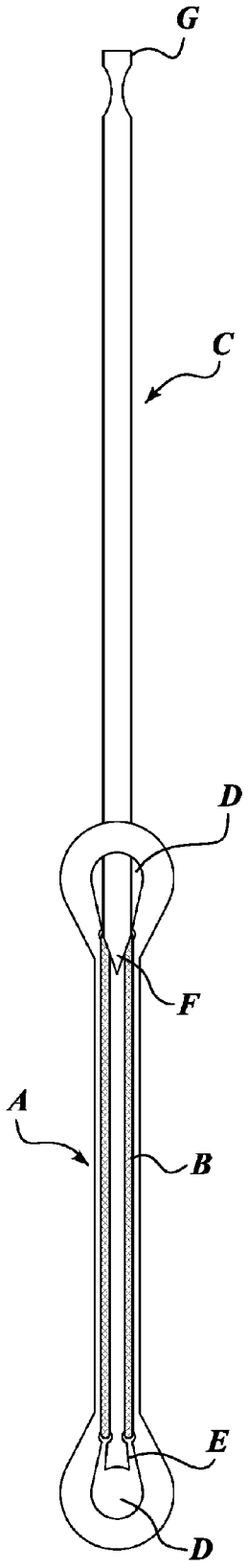
FIGS. 3 and 4 illustrate how the assembled invention works.
Figure 4:
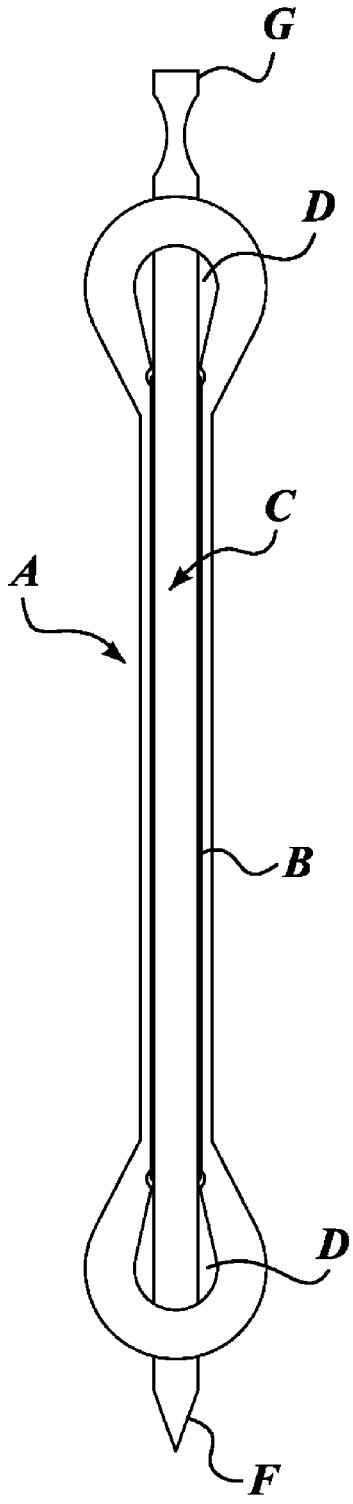

With reference to FIGS. 3 and 4, the characters A, B, and C illustrate the working members of the invention: the flexible body part (A), the elastic band (B), and the pointed contoured stick, pick, or rod (C). FIGS. 3 and 4 illustrate how the members of the invention fit within and around each other. Specifically, FIG. 3 illustrates the insertion of the pointed end F of the contoured stick, pick, or rod (C) through the opening (D) in one end of the body part (A). The contoured end "G" of "C" is not inserted into the opening of the body part (A). The upper opening "D" accommodates the insertion of "C" while retaining the elastic band (B).

FIG. 3 illustrates the elastic band (B) lying flat against the flexible body part (A) and not interfering with the insertion of the pointed end of "C."

With specific reference to FIG. 4, the pointed end "F" of the stick, pick, or rod (C) fits into the lower opening "D," thus securing the body part (A) to the pointed contoured rod (C) while the body part (A) accommodates and retains the elastic band (B).

FIGS. 5, 6, 7, 8, 9, and 10 illustrate a method of use for the invention using the flexible body part (A), the elastic band (B), and the pointed contoured rod (C).

Figure 5:
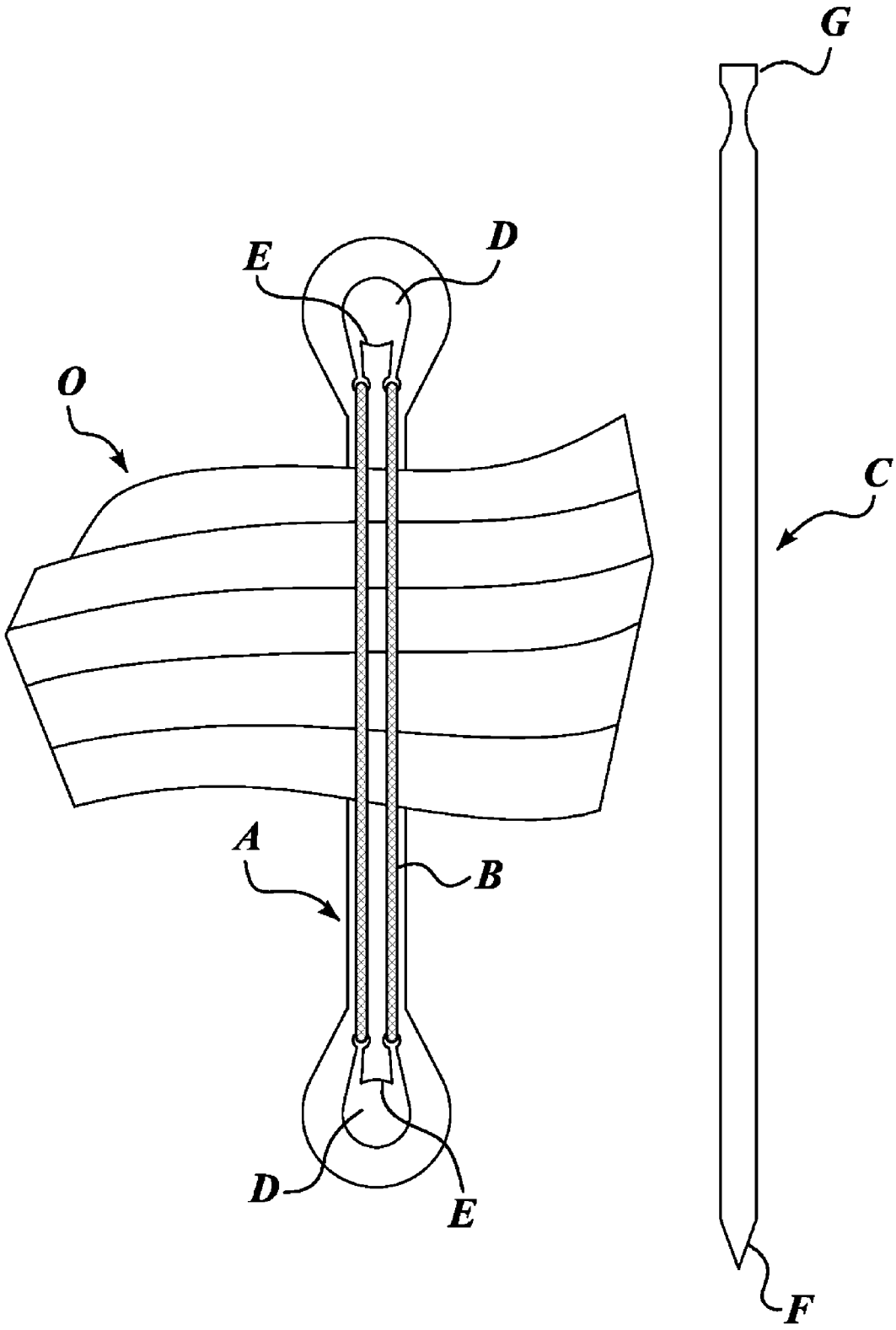
FIGS. 5, 6, 7, 8, 9, and 10 illustrate a general method of use for the invention.

With specific reference to FIG. 5, "O"—as shown, illustrates a flexible material of undefined composition, having been inserted between body part (A) and elastic band (B), and thus retained by the friction and the tension caused by the elastic band (B) being fastened so as to lie flat against flexible body part (A).

Figure 6:
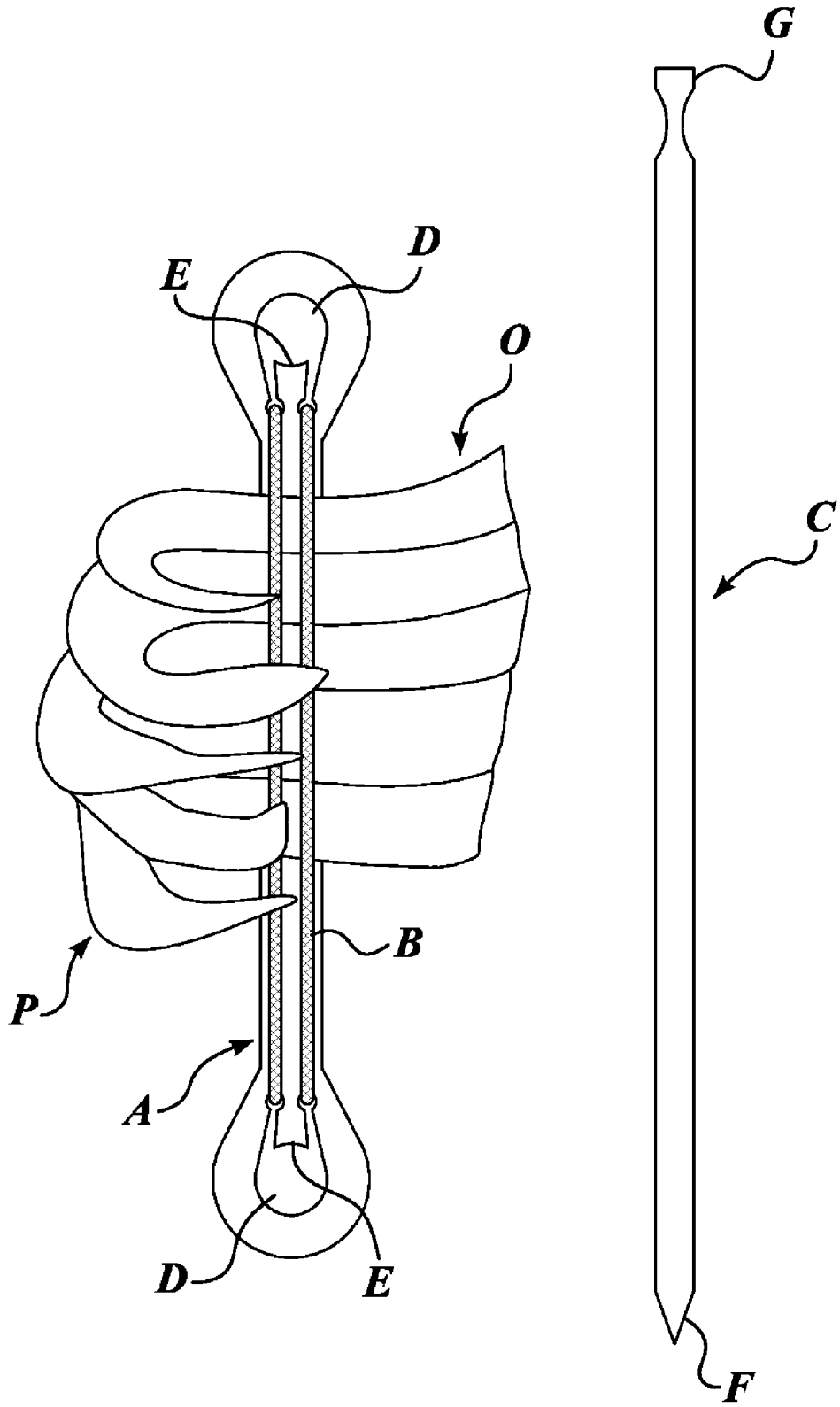
Figure 7:
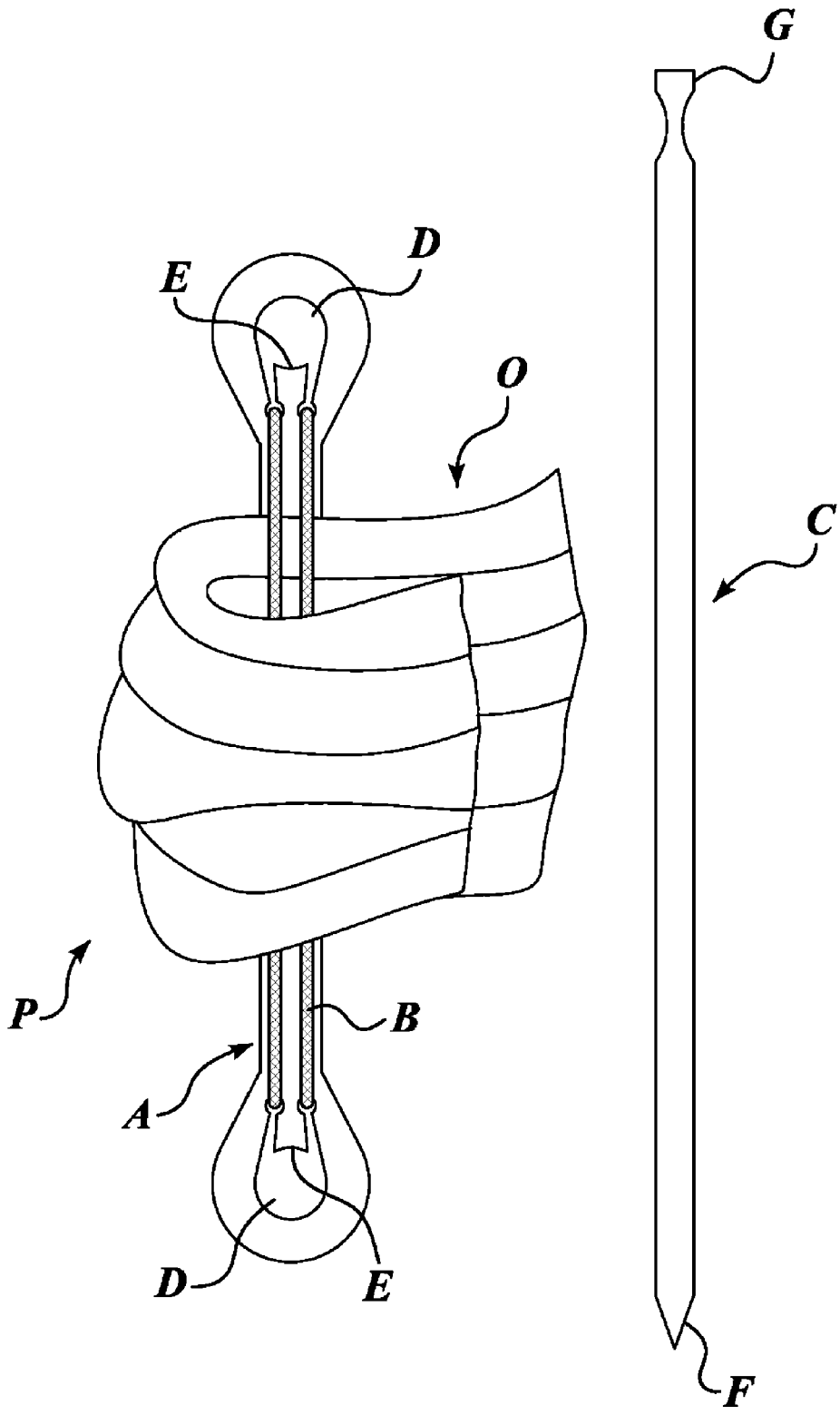

With specific reference to FIGS. 6 and 7, "P"—as shown, illustrates a portion of the flexible material (O) being folded over or rolled to a desired position.

Figure 8:
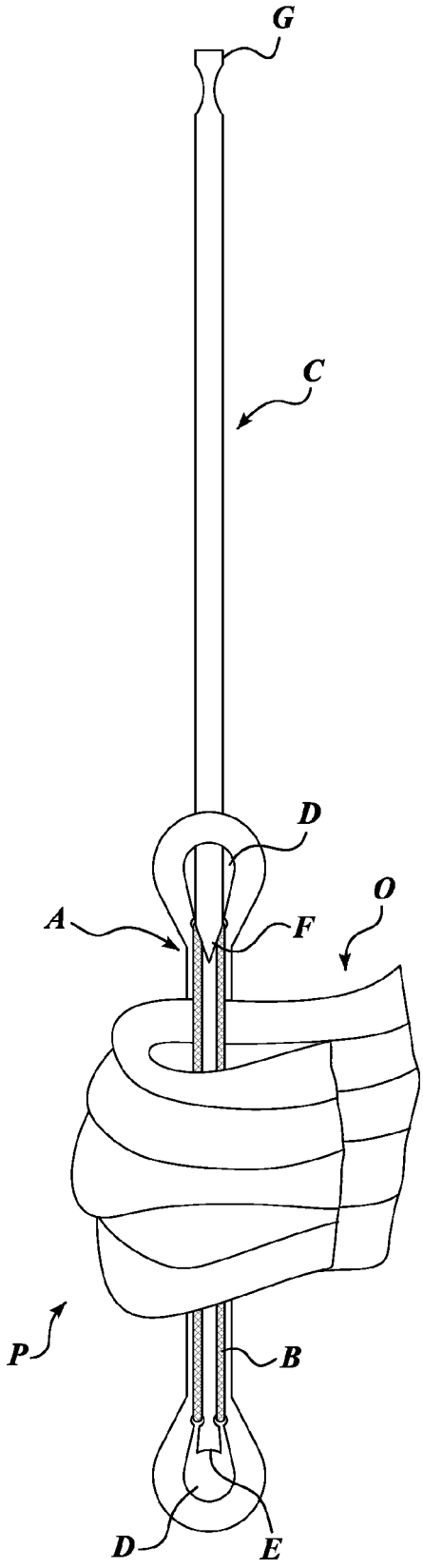

FIG. 8 illustrates the pointed end "F" of contoured rod "C" being inserted into an opening "D" in the upper end of body part (A).

Figure 9:
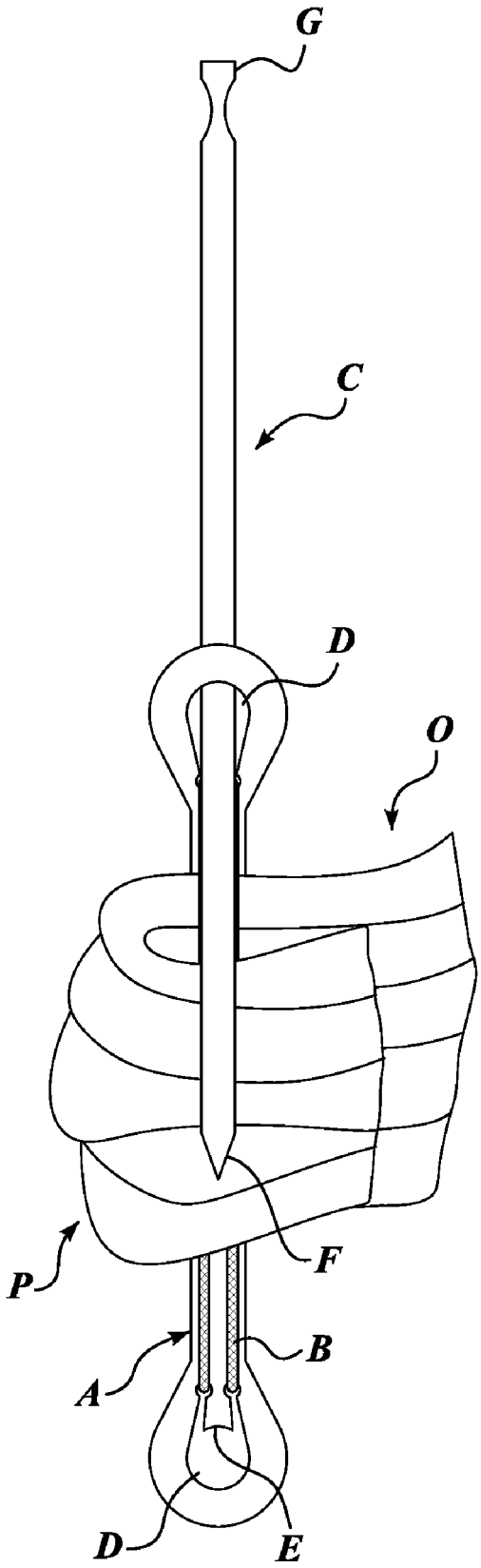

FIG. 9 illustrates the pointed end (F) of the stick, pick, or rod (C) moving towards the opposite end of body part (A) and sliding over flexible material (O), which is arranged in a rolled or folded position.

Figure 10:
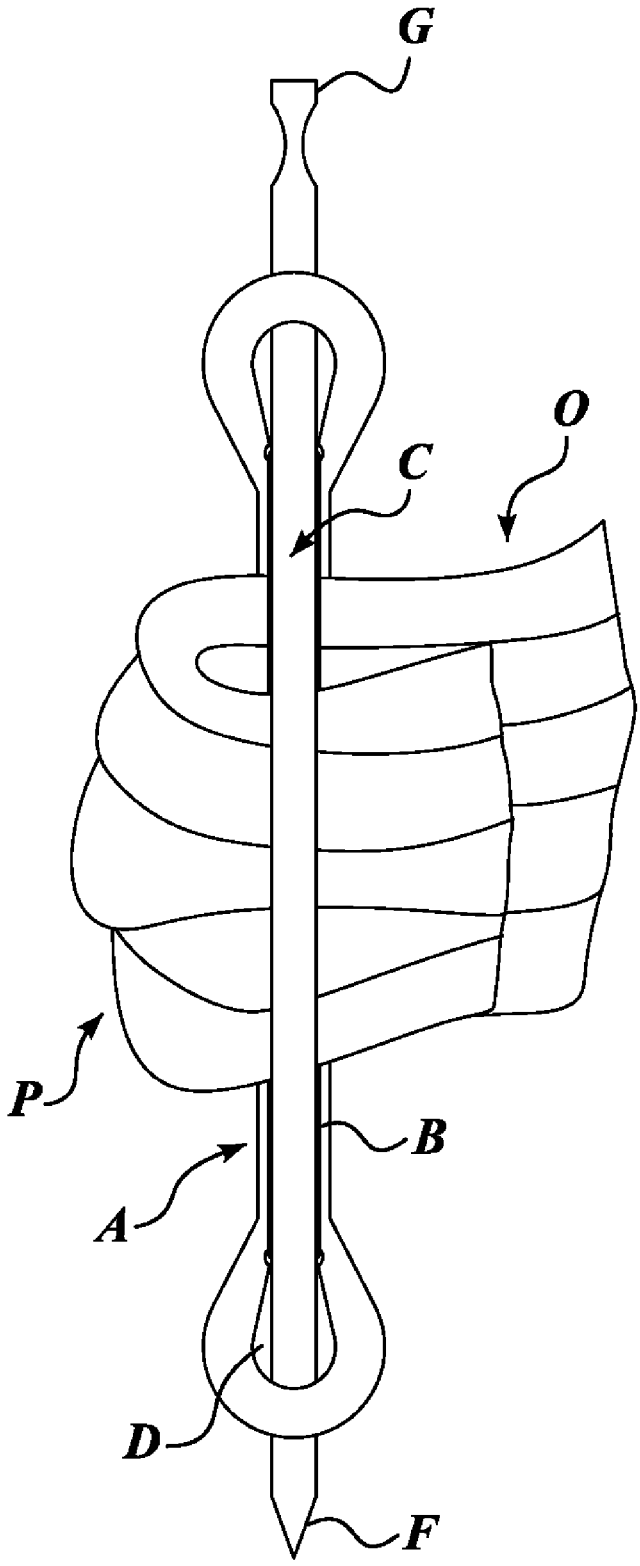

FIG. 10 illustrates the pointed end (F) of the stick, pick, or rod (C) being fastened inside an opening "D" in a lower end of body part (A).

With reference to all drawings, related descriptions, illustrations, and assumptions, it will be understood that the invention is not limited to the descriptions, etc., contained herein and is capable of numerous shapes, customizations, modifications, and substitutions of parts and elements without departing from the spirit of the invention.

I claim:

1. A method of styling a flexible member, comprising:

(a) providing a body part having first and second ends, wherein a first opening is defined at the first end and a second opening is defined at the second end, and wherein a first protrusion extends from the first end and a second protrusion extends from the second end;

(b) securing an elastic member on the first and second protrusions such that the elastic member extends along at least a portion of the body part;

(c) disposing a portion of a flexible member between the elastic member and the body part;

(d) arranging the flexible member into a desired position; and (e) securing the flexible member in its arranged position with respect to the body part by passing an elongated member through the first and second openings in the body part.

2. The method of claim 1, further comprising arranging the flexible member into a desired position by winding, twisting, folding, or rolling the flexible member.

3. The method of claim 1, further comprising arranging the flexible member into a desired position by winding, twisting, folding, or rolling the body part.

4. The method of claim 1, wherein the body part is substantially flexible.

5. The method of claim 1, wherein the elongated member includes a pointed end.

6. The method of claim 1, wherein the elongated member is selected from the group consisting of a rod, a stick, and a pick.

7. The method of claim 1, wherein the first protrusion extends partially into the first opening and the second protrusion extends partially into the second opening.

8. The method of claim 1, wherein the elastic member lies substantially flat along at least a portion of the body part when the elastic member is secured on the first and second protrusions in a first position.

9. The method of claim 1, wherein the elastic member is moved into a second position separated from the body part when the portion of the flexible member is disposed between the elastic member and the body part.

10. The method of claim 1, wherein the elastic member is an elastic band.

* * * * *